US005203725A

United States Patent [19]

Brunker et al.

[11] Patent Number: 5,203,725

[45] Date of Patent: Apr. 20, 1993

[54] BIASED EDGE CARD CONNECTOR

[75] Inventors: David L. Brunker, Naperville; Frank A. Harwath, Downers Grove; Kent E. Regnier, Lombard, all of Ill.

[73] Assignee: Molex Incorporated, Lisle, Ill.

[21] Appl. No.: 852,441

[22] Filed: Mar. 16, 1992

[51] Int. Cl.[5] ..... H01R 23/70

[52] U.S. Cl. ..... 439/636; 439/62; 439/60; 439/592

[58] Field of Search ..... 439/59, 62, 630–637, 439/326–328, 260, 259, 592

[56] References Cited

U.S. PATENT DOCUMENTS

| | | | |
|---|---|---|---|
| 3,740,699 | 6/1973 | Johnson et al. | 439/637 |
| 4,370,012 | 1/1983 | Grabbe et al. | 339/75 MP |
| 4,370,017 | 1/1983 | Grable et al. | 439/635 |
| 4,477,138 | 10/1984 | Andrews, Jr. et al. | 339/65 |
| 4,585,288 | 4/1986 | Aikens | 339/75 MP |
| 4,737,120 | 4/1988 | Grabbe et al. | 439/326 |
| 4,826,446 | 5/1989 | Juntwait | 439/326 |
| 4,946,403 | 8/1990 | Billman et al. | 439/326 |
| 5,015,196 | 5/1991 | Yamada | 439/326 |
| 5,051,099 | 9/1991 | Pickles et al. | 439/108 |

FOREIGN PATENT DOCUMENTS

| | | | |
|---|---|---|---|
| 2255748 | 5/1973 | Fed. Rep. of Germany | 439/637 |
| WO8906447A | 7/1989 | PCT Int'l Appl. . | |

OTHER PUBLICATIONS

IBM Tech. Disclosure Bulletin, E. C. Uberbacher, "Split Socket", vol. 8, No. 8, Jan. 1966.

*Primary Examiner*—David L. Pirlot
*Attorney, Agent, or Firm*—Charles S. Cohen

[57] ABSTRACT

An edge connector is provided for a printed circuit board having a mating edge and a plurality of contact pads adjacent the edge. The connector includes an elongated dielectric housing having a board-receiving slot for receiving the mating edge of the printed circuit board. A plurality of spring contact elements are mounted in the housing along at least one side of the slot. The spring contact elements have spring contact portions extending into the slot for contacting respective ones of the contact pads on the printed circuit board. A surface on the housing at the one side of the slot defines a datum plane beyond which the spring contact portion of at least one of the spring contact elements extends into the slot. A biasing spring on the housing biases the printed circuit board against the surface, thereby deflecting the spring contact portion of the at least one spring contact element a predetermined amount.

18 Claims, 3 Drawing Sheets

BIASED EDGE CARD CONNECTOR

FIELD OF THE INVENTION

This invention generally relates to the art of electrical connectors and, particularly, to a high-speed edge connector for a printed circuit board.

BACKGROUND OF THE INVENTION

In today's high speed electronic equipment, it is desirable that all components in an interconnection path be optimized for signal transmission characteristics, otherwise the performance of the system will be impaired or degraded. Such characteristics include risetime degradation or system bandwidth, crosstalk, impedance control and propagation delay. Ideally, the characteristics of an electrical connector would have little or no affect on the interconnection system. An ideal connector would be "transparent". In other words, the system would function as if the connector did not exist as part of the interconnection. However, such an ideal connector is generally impractical or impossible, and continuous efforts are made to develop electrical connectors which have as little affect on the system as possible.

It has been found that inductance is one of the major concerns in designing an ideal connector. This is particularly true in electrical connectors for high speed electronic equipment, i.e. involving the transmission of high frequencies. A very popular type of electrical connector for such applications commonly is termed an "edge card" connector. In other words, an edge connector is provided for receiving a printed circuit board having a mating edge and a plurality of contact pads adjacent the edge. Such edge connectors have an elongated housing defining an elongated slot for receiving the mating edge of the printed circuit board. A plurality of terminals are spaced along one or both sides of the slot for engaging the contact pads adjacent the mating edge of the board. Most often, the terminals have some form or another of spring contact elements for biased engagement against the contact pads on the board and, most often, the spring contact elements are in one form or another of a cantilevered spring arm.

With electrical connectors of the character described above, given electrical contacts of otherwise comparable geometry, the longer the spring contact arm or contact beam, the greater the inductance of the terminal and, cumulatively, the electrical connector itself. Therefore, it is desirable to have as short a contact beam as possible. Shortening the contact beam creates various problems. For instance, it is difficult to maintain constant contact pressures in a multiplicity of spring contact beams, particularly when the beams are relatively short. In addition, it is difficult to compensate for variances in the widths of printed circuit boards when the contact beams are short. In fact, such spring contacts can take a permanent set even when the contacts are displaced only a small amount. The contacts might take a permanent set after a relatively wide printed circuit board has been inserted into the connector. This permanent set of the contacts would make the connector ineffective when a relatively narrow board subsequently is inserted into the connector. If the contact beams do not make effective electrical connection with the contact pads on the edge of the printed circuit board, an unreliable or ineffective electrical connection results, rendering the connector effectively useless.

This invention is directed to solving these problems by providing an edge card connector of the character described wherein the deflection of the spring contact elements is controlled, resulting in the ability to design very short spring contact beams.

SUMMARY OF THE INVENTION

An object, therefore, of the invention is to provide a new and improved edge connector for a printed circuit board having a mating edge and a plurality of contact pads adjacent the edge.

Generally, the edge connector includes an dielectric housing having a board-receiving slot for receiving the edge of the printed circuit board. A of spring contact elements are mounted in the housing along at least one side of the slot. The spring contact elements have spring contact portions extending into the slot for contacting respective ones of the contact pads on the printed circuit board.

The invention contemplates that the housing include surface means at the one side of the slot defining a datum plane beyond which the spring contact portion of at least one of the spring contact elements extends into the slot. Biasing means is provided in the housing for biasing the printed circuit board against the surface means, thereby deflecting the spring contact portion of at least one spring contact element a predetermined amount.

With the above structural combination of an edge connector of the character described, it has been found that the lengths of a spring contact arm or beam, from a rigid base portion of the contact element to a point of contact with a respective one of the contact pads on the printed circuit board, can be as small as on the order of 0.09 inch. Such a spring contact arm can project into the slot means, beyond the surface means which defines the datum plane, approximately 0.005 inch. Such short spring contact arms or beams result in very small inductance for the contact beam.

Various embodiments of biasing means are illustrated herein. In one embodiment, the biasing means includes a second, unitary spring portion of the one spring contact element. In another embodiment, the biasing means may be provided by a spring contact portion of a spring contact element other than the one spring contact element. The biasing means may be provided by an integral portion of the housing, such as a unitarily molded portion of a plastic housing. The biasing means may be provided by a spring device mounted on the housing independent of the spring contact elements. Still further, the biasing means may be provided by a cam member, independent of the housing, positionable in the slot means for camming against a side of the printed circuit board opposite the datum plane.

The invention also contemplates a feature wherein the surface means which define the datum plane be provided by a plurality of projections forming substantially line contact between the projections and the printed circuit board. The projections may be formed as rib portions of the housing located between the spring contact elements.

Such line contacts define the datum plane and support the side of the printed circuit board opposite the biasing means. During insertion the contact pads travel parallel to these rib portions but not over them. Therefore, polymer contamination of the contact surface due to direct contact between the contact pads and the plastic housing is eliminated.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
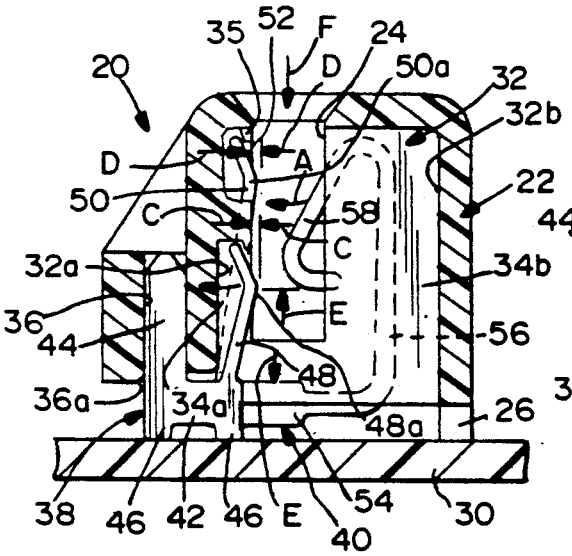
FIG. 1 is a vertical section, with certain portions removed, through an elongated edge connector embodying the concepts of the invention.
Figure 13:
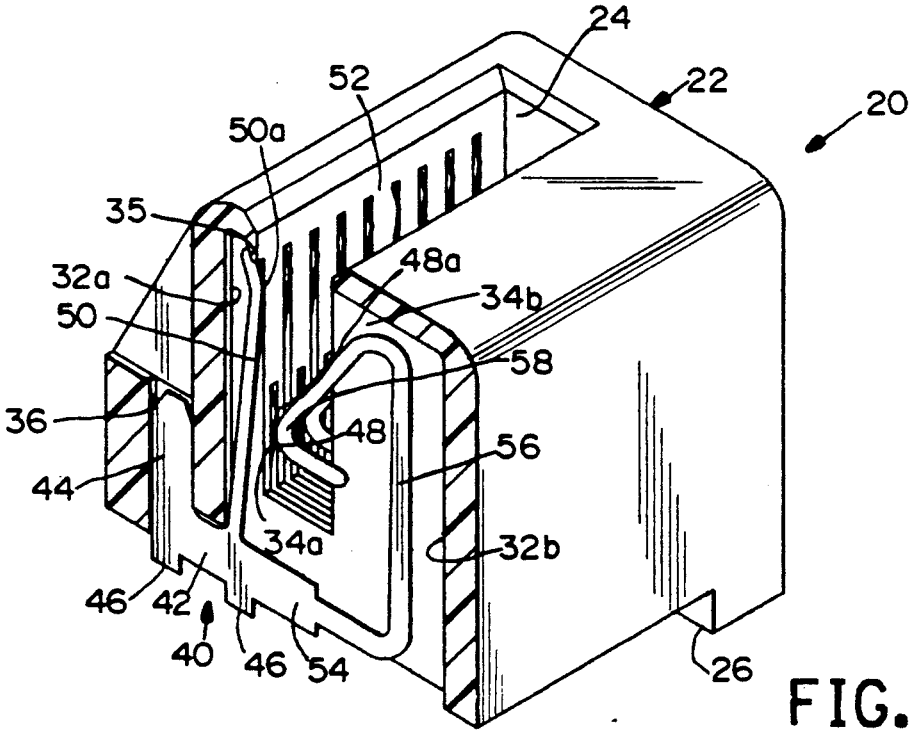
FIG. 13 is a perspective view, partly in section, of the connector of FIG. 1 showing the long contact element and its integral biasing means.

Referring to the drawings in greater detail, and first to FIGS. 1 and 13, the invention is embodied in an edge connector, generally designated 20, for receiving a printed circuit board (not shown) having a mating edge and plurality of contact pads adjacent the edge. These types of connectors commonly are called "edge card" connectors in that they have receptacle means in the form of slots for allowing insertion of an edge of printed circuit boards into contact areas of the connectors. Such connectors are well known in the industry as exemplified by U.S. Pat. No. 4,575,172, assigned to the assignee of this invention. Such connectors are elongated and have rows of spring contact elements spaced along one or both sides of an elongated card-receiving slot extending lengthwise of a dielectric housing. The spring contact elements engage contact pads spaced along a mating edge of the printed circuit board which is inserted into the slot.

With this understanding, edge connector 20 includes a dielectric housing, generally designated 22, having a board receiving slot means 24 running the length of the connector for receiving the edge of the printed circuit board. A plurality of standoffs 26 depend from housing 22 for engaging a surface 28 of a second printed circuit board 30. Often, printed circuit board 30 is called a mother board and the printed circuit board which is inserted into slot means 24 is called a daughter board.

Still further, housing 22 includes a plurality of transverse cavities 32 spaced longitudinally of slot means 24 for receiving alternating, differently configured terminals, as described below. Specifically, each cavity 32 has a cavity portion **32*a* on one side of slot means 24 (the left-hand side as viewed in FIG. 1) and a cavity portion 32*b* on the opposite side of the slot means (the right-hand side as viewed in FIG. 1). Cavities 32 are separated lengthwise of the elongated housing by wall means or partitions which include wall portions 34*a* separating cavity portions 32*a* and wall portions 34*b* separating cavity portions 32*b*. Wall portions 34*a* are formed so as to create an overhang portion 35 over cavity portion 32*a* in order to protect the top portion of the terminals 38 and 40** and to prevent inadvertent stubbing thereof.

Housing 22 also includes a plurality of holes 36 outside cavities 32 and generally in transverse alignment therewith, for purposes described hereinafter. Each hole 36 includes a lower mouth **36*a* opening at the bottom of housing 22**. The entire housing is unitarily molded of dielectric material such as plastic or the like.

Generally, a plurality of terminals are mounted in housing 22, spaced longitudinally of the housing and corresponding to the plurality of transversely aligned cavities 32 and holes 36. Before describing the terminals in detail, it should be understood that the printed circuit board which is inserted into slot means 24 often has a plurality of contact pads defining two rows of pads parallel to and generally along the edge of the printed circuit board, i.e. the mating edge which is inserted into the slot means. One row of contact pads is located near the absolute edge of the board, and the other row of contact pads is spaced inwardly from the one row. Therefore, conventionally, terminals are located on housing 22 with contact elements alternating lengthwise of the housing for alternatingly engaging the contact pads in the two rows thereof along the mating edge of the printed circuit board.

More particularly, terminals, generally designated 38 and 40, are mounted in housing 22 in an alternating array lengthwise of the housing. In other words, terminals 38 alternate between adjacent terminals 40. Both configurations of terminals 38 and 40 are similar to the extent that they have base portions 42, barb portions 44 projecting upwardly from the base portions and contact feet 46 projecting downwardly from the base portions. The terminals are mounted to the housing by inserting barb portions 44 through mouths **36*a* of holes 36 from the bottom of housing 22 to create an interference fit between the barbs and the side walls of their respective holes. If desired, serrations could be formed in the edges of barbs 44. Contact feet 46 engage circuit traces on top surface 28 of printed circuit board 30 (the mother board). Terminals 38 have cantilevered spring contact elements 48 projecting upwardly from their respective base portions 42, and terminals 40 have cantilevered spring contact elements 50 projecting upwardly from the respective base portions. If desired, contact feet 46** could be replaced as known in the art to provide solder tails that project through holes in the printed circuit board.

It can be seen in FIG. 1 that spring contact element 48 of terminal 38 is shorter than spring contact element 50 of terminal 40. Therefore, hereinafter, spring contact element 48 may be termed the "short" element, and spring contact element 50 may be termed the "long" element. Regardless, it can be seen that both configurations of spring contact elements 48 and 50 project into slot means 24 for engaging the contact pads along the mating edge of the printed circuit board (daughter board) inserted into the slot means.

Generally, the invention contemplates that housing 22 be provided with surface means along the side of slot means 24 from which spring contact elements 48, 50 project, to define a datum plane beyond which portions of the spring contact elements extend into the slot means. In addition, biasing means are provided on the housing for biasing the printed circuit board against the surface means, thereby deflecting the spring contact elements a constant and predetermined amount.

More particularly, still referring to FIG. 1, wall portions 34*a* between cavity portions 32*a* have edges 52 which are in alignment lengthwise of housing 22 and which define one side (the left-hand side as viewed in the drawings) of slot means 24. These edges combine to define the datum plane beyond which portions of spring contact elements 48 and 50 project as seen in FIG. 1. Therefore, it can be understood that if the daughter printed circuit board is biased against the datum plane in the direction of arrow "A", the datum plane provides an abutment or stop means to prevent further movement of the board and further deflection of the spring contact elements. With the board engaging spring contact elements 48 and 50, the spring contact elements will be deflected in the direction of arrows "B". Once the board engages the datum plane defined by edges 52 of wall portions 34*a*, the spring contact elements cannot be deflected any further. Consequently, the deflection of the spring contact elements is predetermined and constant, as indicated by arrows "C" for spring contact element 48 and arrows "D" for spring contact element 50.

With the above-described concept, it can be understood that such problems as variations in the thicknesses of printed circuit boards are obviated. In other words, regardless of the thickness of the board, when it is biased against datum plane 52 in the direction of arrow "A", the spring contact elements can be deflected only the described predetermined amount. Therefore, the length of the spring contact elements do not have to be made excessively long to compensate for variances in board thicknesses. In addition, by effecting a constant deflection of the spring contact elements, the elements effectively exert constant contact pressure onto the contact pads of the board, which also has been a continuing problem with edge connectors heretofore available.

By knowing the precise deflection of the spring contact elements, as described above, the length of the spring contact elements from base portion 42 to points of contact 48*a* and 50*a* for spring contact elements 48 and 50, respectively, can be made as short as possible. In fact, the length of short spring contact element 48 from base portion 42 to contact point 48*a*, as indicated by arrows "E", has been designed to be 0.089 inch. It is anticipated that length could range from approximately 0.050 to 0.135 inches. The short spring contact element projects into slot means 24 (i.e. the distance from datum plane 52 as indicated by arrows "C") is approximately 0.005 inch and could range from approximately 0.002 to 0.010 inch.

As generally stated above, biasing means are provided in housing 22 for biasing the daughter printed circuit board against datum plane 52 and deflecting spring contact elements 48 and 50. In the embodiment illustrated in FIG. 1, spring contact elements 40 have base portions which project transversely across the respective cavities 32, as indicated at 54, with a spring arm 56 projecting upwardly into cavity portion 32*b*, and with a spring element 58 projecting outwardly into slot means 24 from the side of the slot means opposite datum plane 52. It can be seen that spring element 58 is significantly larger and, thereby, intended to have a greater biasing force than the reactionary deflection forces of a pair of spring contact elements 48 and 50. Therefore, when the daughter printed circuit board is inserted into slot means 24 in the direction of arrow "F", spring element 58, which is bent back from the distal end of spring arm 56, will bias the board in the direction of arrow "A", against datum plane 52 and deflecting spring contact elements 48 and 50 the predetermined amount indicated by arrows "C" and "D".

Figure 2:
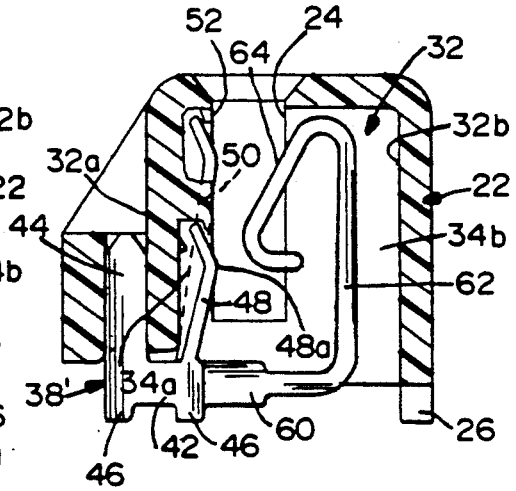
FIG. 2 is a vertical section similar to that of FIG. 1 of an alternative embodiment with the biasing means integral with the short contact element.

FIG. 2 shows an alternate form of biasing means, and like numerals have been applied to like components in FIG. 2 corresponding to those components described in relation to the embodiment of FIG. 1. More particularly, in the embodiment of FIG. 2, a terminal 38' again includes a base portion 42, a barb portion 44 and a short spring contact element 48. However, the "short" terminal has its base portion extended, as at 60, with a spring arm 62 projecting upwardly therefrom and bent back downwardly to define a second spring portion 64 opposing spring contact element 48. Otherwise, the biasing means functions the same as described above in relation to spring arm 56 and spring element 58 of terminal 40.

Figure 3:
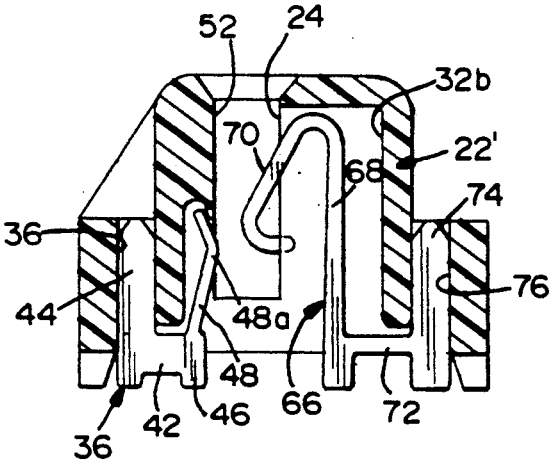
FIG. 3 is a vertical section through another alternative embodiment wherein the biasing means is provided by an independent spring beam member.

FIG. 3 shows still another embodiment of a biasing means, wherein the biasing means is provided by a separate spring element, generally designated 66, mounted in a housing 22' on the side of slot means 24 opposite the terminals, such as the one terminal 38 shown. Biasing spring 66 again includes a spring arm 68 projecting upwardly into selected ones of cavity portions 32*b*, with a spring element 70 bent downwardly and projecting into the slot means. The spring element has a base portion 72, with a barb 74 projecting upwardly into a hole 76 in the housing. Again, this biasing spring is provided for biasing the daughter printed circuit board against datum plane 52 and deflecting the spring contact elements of the terminals, such as the one spring contact element 48 shown.

Figure 4:
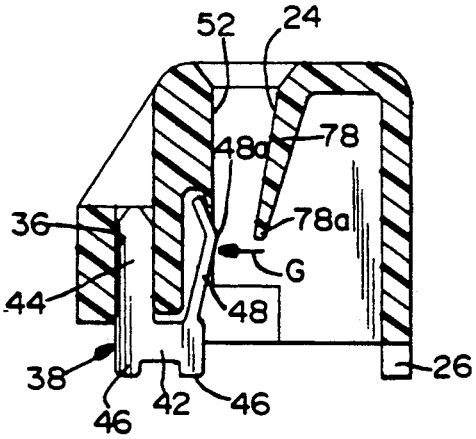
FIG. 4 is a vertical section through still another embodiment wherein the biasing means is integral with the housing.

FIG. 4 shows a form of biasing means wherein an integral spring finger 78 is molded unitarily with a housing 22''. Spring finger 78 projects into slot means 24, and a distal end 78*a* of the integral spring finger biases the daughter printed circuit board in the direction of arrow "G" against datum plane 52 to deflect spring contact element 48 of terminal 38.

Figure 5:
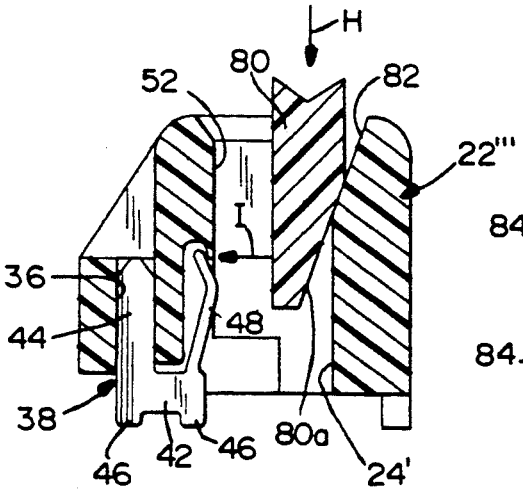
FIG. 5 is a vertical section through still another embodiment wherein the biasing means is provided by a separate cam member.

FIG. 5 shows an embodiment of a biasing means wherein a cam member 80 is separate from the housing means and is inserted into slot means 24' in the direction of arrow "H". The cam member has a cam surface 80a for engaging a cam surface 82 on housing 22''' for biasing the daughter printed circuit board in the direction of arrow "I" against datum plane 52 to deflect spring contact element 48 of terminal 38.

Figure 6:
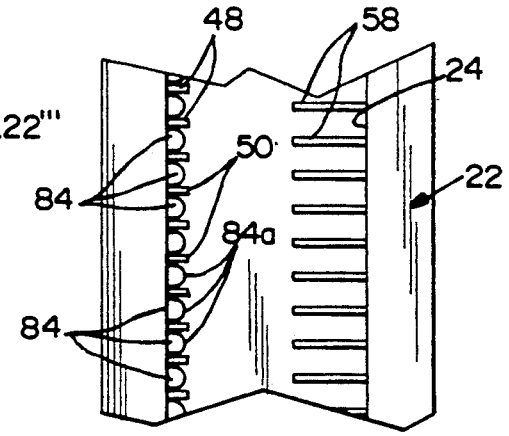
FIG. 6 is a fragmented top plan view of a section of still another embodiment illustrating the feature of a ribbed surface defining the datum plane for the spring contact members.

FIG. 6 shows a fragmented, somewhat schematic illustration of a means for defining the datum plane of the connector to establish substantially line contacts with the daughter printed circuit board. As schematically illustrated, and referring back to FIG. 1, it can be seen that spring elements 58 project into slot means 24 from one side thereof, and spring contact elements 48 and 50 project into the slot means from the opposite side thereof. Ribs 84 are formed integrally with housing 22 between the terminals which define spring contact elements 48 and 50. The inner edges of the ribs are rounded to provide a tangential line contacts 84a for engaging the printed circuit board. An imaginary plane drawn through the edges of the ribs define the datum plane against which the printed circuit board is biased. By providing line contacts between the datum plane and the printed circuit board, the surface area of the board, and the contact pads in particular, in contact with the plastic material of the housing is minimized to minimize polymer contamination of the contact pads on the board.

Figure 7:
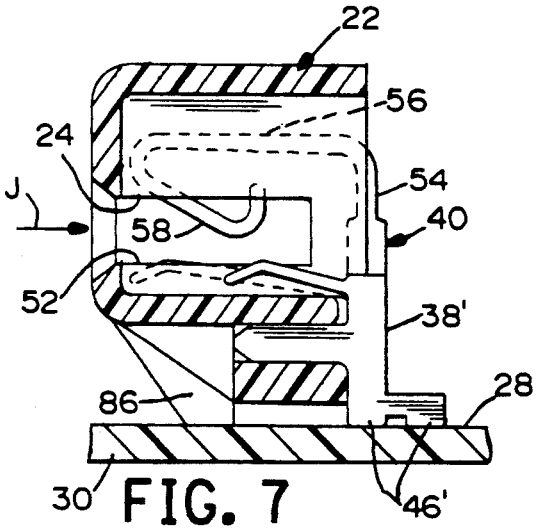
FIG. 7 is a vertical section through still another embodiment which is similar to FIG. 1, but with the terminals configured for application of the connector as a right-angled connector.

FIG. 7 shows an embodiment of the invention where, again, like numerals have been applied to designate like components described in relation to the embodiment of FIG. 1. This illustration shows that the connector can be rotated 90° to provide a right-angled configuration with mother printed circuit board 30. In this embodiment, contact feet 46' of a "short" terminal 38' depend from the bottom of housing 22 which was the side of the housing as illustrated in FIG. 1. Standoffs 86 projects downwardly from the housing for engaging top surface 28 of the printed circuit board. Otherwise, the connector functions the same as described above in relation to FIG. 1, with the daughter printed circuit board being inserted into slot means 24 in the direction of arrow "J".

Figure 8:
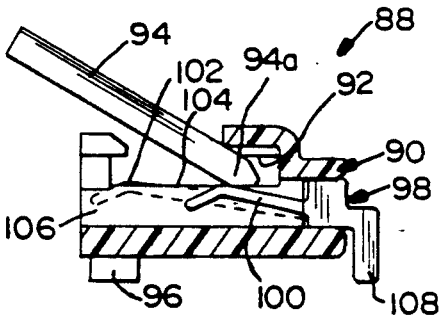
FIGS. 8–10 are sequential views of an alternate form of connector involving a rotating and latch configuration for the printed circuit board.
Figure 9:
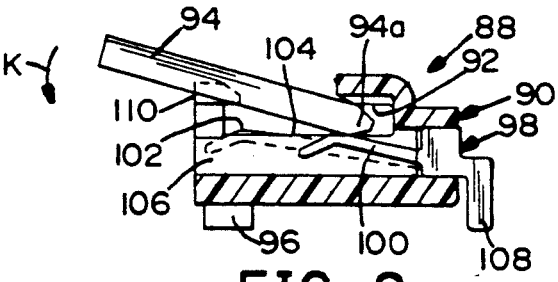
Figure 10:
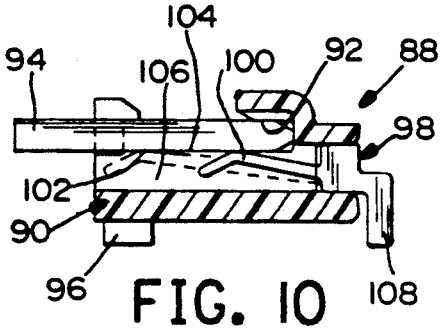

FIGS. 8–10 show the invention embodied in an electrical connector, generally designated 88, which includes a housing, generally designated 90, defining a slot means 92 for receiving a mating edge 94a of a daughter printed circuit board 94. Housing 90 is mounted to the top of a mother printed circuit board by means of standoffs 96. Alternating "short" and "long" terminals are mounted on the housing, one short terminal, generally designated 98, being fully visible in the figures. The terminals define spring contact elements 100 and 102 projecting into slot means 92 beyond a datum plane defined by edges 104 of wall portions 106 disposed between alternating ones of the terminals. The terminals have contact feet 108 for engaging circuit traces on the mother printed circuit board.

In operation of connector 88 (FIGS. 8–10), mating edge 94a of daughter board 94 is inserted into slot means 92 as shown in FIG. 8. With the slot means acting as a fulcrum, the board is rotated in the direction of arrow "K" as shown in FIG. 9. The board is rotated until its side edges snap behind latches 110 at opposite ends of the connector, integral with the housing. In this fully mated condition, as with the other embodiments of the invention, the housing biases the daughter board against datum plane 104, effecting a predetermined and constant deflection of the spring contact elements 100 and 102. Again, housing cantilevered wall portion 112 which defines slot means 92 can deflect slightly, to apply a biasing pressure.

Figure 11:
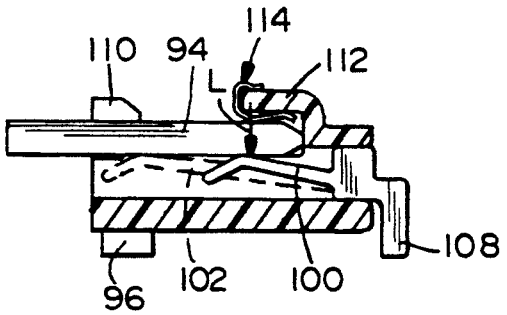
FIG. 11 is a view similar to that of FIG. 10, wherein the connector employs an auxiliary biasing spring independent of the housing.

FIG. 11 shows an embodiment which is substantially identical to that shown in FIG. 10, with daughter board 94 in its fully latched condition. In the embodiment of FIG. 11, a U-shaped auxiliary spring member 114 is used, embracing wall portion 112, for exerting biasing pressure against daughter board 94 in the direction of arrow "L" to deflect spring contact elements 100 and 102.

Figure 12:
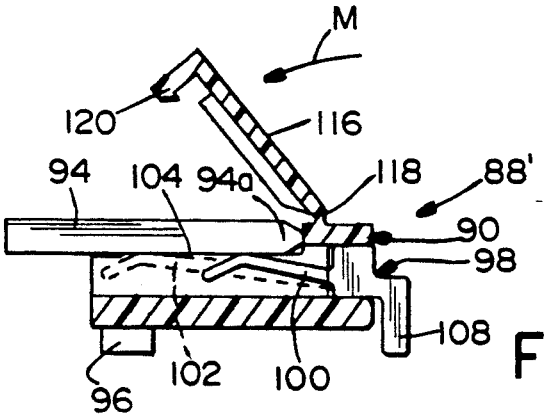
FIG. 12 is a vertical section through a further embodiment of the invention incorporating a molded hinge and latch member for the connector.

Lastly, FIG. 12 shows an embodiment of a connector, generally designated 88', which is somewhat similar to the configuration of connectors shown in FIGS. 8–10 and 11. Consequently, like numerals are applied in FIG. 12 to designate like components described above in relation to FIGS. 8–11. In this embodiment, daughter board 94 is laid against datum plane 104. A separate hinge member or cover 116 is hingedly connected to housing 90 by a living integral hinge 118. A hooked latch 120 is formed on the distal end of hinge member 116. The hinge member is rotated in the direction of arrow "M" against daughter board 94 to bias the board against datum plane 104 and deflect spring contact elements 100 and 102. Latch 120 engages a complementary latch surface (not shown) on housing 90 to hold hinged member 116 in its operative position. In the alternative to the cover acting to bias the board against the datum plane, a secondary spring may also be added for biasing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an edge connector for receiving a printed circuit board having a mating edge and a plurality of contact pads adjacent the edge, said connector including an elongated dielectric housing having a board-receiving slot means for receiving the mating edge of the printed circuit board, and a plurality of spring contact elements mounted in the housing along at least one side of the slot means and having first spring contact portions extending into the slot means for contacting respective ones of the contact pads on one side of the printed circuit board, surface means on the housing at said one side of the slot means defining a datum plane beyond which the first spring contact portion of the spring contact elements extends into the slot means, and biasing means for biasing the printed circuit board against the surface means, thereby deflecting the first spring contact portion of said spring contact elements a predetermined amount, the improvement comprising:

said biasing means being a second spring contact portion extending into said slot means for contacting the printed circuit board on a side opposite said one side of the board and biasing said one side of the board against said datum plane and said first spring contact portions, each said spring contact element being a monolithic structure including said first and second spring contact portions.

2. In an edge connector as set forth in claim 1, wherein aid first spring contact portions normally extend past said surface means into said slot means when said printed circuit board is absent from said slot means in a board receiving condition and the distance between a portion of said second spring contact portion adapted to contact said printed circuit board and the datum plane when the connector is in its board receiving condition is less than the thickness of the printed circuit board, whereby insertion of said printed circuit board into said slot means directly causes deflection of the first contact portion out of the slot means and deflection of the second contact portion.

3. In an edge connector as set forth in claim 1, wherein the first and second spring contact portions each include a spring arm projecting from a base portion.

4. In an edge connector as set forth in claim 3, wherein the length of said first spring contact arm from the base portion to a point of contact with a respective one of the contact pads on the printed circuit board when the printed circuit board is operatively positioned within the slot means is on the order of 0.09 inch.

5. In an edge connector as set forth in claim 4, wherein the spring contact portion of said first spring contact elements projects into the slot means beyond said datum plane approximately 0.005 inch.

6. In an edge connector as set forth in claim 1, wherein said surface means which define said datum plane comprise a plurality of projections providing substantially line contact between the projections and the printed circuit board.

7. In an edge connector as set forth in claim 6, wherein said projections comprise rib portions of the housing located between the spring contact elements.

8. In an edge connector for receiving a printed circuit board having a mating edge and a plurality of contact pads adjacent the edge, said connector including an elongated dielectric housing having a board-receiving slot for receiving the mating edge of the printed circuit board, and a plurality of spring contact elements mounted in the housing along at least one side of the slot, each spring contact element having a first spring contact portion extending into the slot for contacting a contact pad on one side of the printed circuit board, surface means on the housing at said one side of the slot defining a datum plane beyond which the first spring contact portion of the spring contact elements extends into the slot, and biasing means for biasing the printed circuit board against the surface means, thereby deflecting the first spring contact portion of said spring contact elements a predetermined amount, the improvement comprising:

said biasing means being a resilient portion of the housing extending into said slot for contacting the printed circuit board on a side opposite said one side of the board and biasing said one side of the board against said datum plane and said first spring contact portions, said biasing means and said housing being monolithic.

9. In an edge connector as set forth in claim 8, wherein said first spring contact portions normally extend past said surface means into said slot when said printed circuit board is absent from said slot in a board receiving condition and the distance between a portion of said resilient housing portion adapted to contact said printed circuit board and the datum plane when the connector is in its board receiving condition is less than the thickness of the printed circuit board, whereby insertion of said printed circuit board into said slot directly causes deflection of the first contact portion out of said slot and deflection of the resilient housing portion.

10. In an edge connector as set forth in claim 8 further comprising first and second spring contact elements, said first contact elements having cantilevered contact beams of a first length and said second contact elements having cantilevered contact beams of a second length longer than said first length.

11. In an electrical connector as set forth in claim 8, wherein the spring contact portion of said spring contact element comprises a spring arm projecting from a base portion.

12. In an electrical connector as set forth in claim 11, wherein the length of said spring contact arm from the base portion to a point of contact with the complementary contact is on the order of 0.09 inch.

13. In an electrical connector as set forth in claim 12, wherein the spring contact portion of said spring contact element projects into the receptacle beyond said surface means approximately 0.005 inch.

14. In an edge connector for receiving a printed circuit board having a mating edge and a plurality of contact pads adjacent the edge, said connector including an elongated dielectric housing having a board-receiving slot for receiving the mating edge of the printed circuit board, and a plurality of spring contact elements mounted in the housing along at least one side of the slot, each spring contact element having a first spring contact portion extending into the slot for contacting a contact pad on one side of the printed circuit board, surface means on the housing at said one side of the slot defining a datum plane beyond which the first spring contact portion of the spring contact elements extends into the slot, and biasing means for biasing the printed circuit board against the surface means, thereby deflecting the first spring contact portion of said spring contact elements a predetermined amount, the improvement comprising:

said biasing means being at least one resilient deflectable member separate from said spring contact elements and fixedly mounted to said housing so that a portion thereof extends into said slot for contacting the printed circuit board on a side opposite said one side of the board in order to bias said one side of the board against said datum plane and said first spring contact portions, and the distance between said portion of said resilient deflectable member adapted to contact said printed circuit board and the datum plane when the connector is in its board receiving condition is less than the thickness of the printed circuit board, whereby insertion of said printed circuit board into said slot directly causes deflection of both the first contact portion and the resilient deflectable member.

15. In an edge connector as set forth in claim 14, wherein insertion of said board into said slot deflects said first spring contact portions out of said slot.

16. In an edge connector as set forth in claim 14 further comprising first and second spring contact elements, said first contact elements having cantilevered contact beams of a first length and said second contact elements having cantilevered contact beams of a second length longer than said first length.

17. In an edge connector as set forth in claim 1 further comprising first and second spring contact elements, said first contact elements having cantilevered contact beams of a first length and said second contact elements having cantilevered contact beams of a second length longer than said first length.

18. In an edge connector as set forth in claim 17 wherein said second contact element is said includes said second spring contact portion.

* * * * *